United States Patent [19]

Depondt et al.

[11] 4,245,447

[45] Jan. 20, 1981

[54] MULTI-USE METAL BUILDING

[75] Inventors: Paul Depondt, Soisy-sous-Montmorency; Claude Echalier, Paris; Albert Levy, Saint-Germain-les-Corbeilles; Louis Boussin, Champigny-sur-Marne, all of France

[73] Assignees: Societe Nouvelle de Constructions Industrialisees, Yerres; Architectes Internationaux Paul Depondt, Cergy, both of France

[21] Appl. No.: 10,685

[22] Filed: Feb. 9, 1979

[30] Foreign Application Priority Data

Feb. 9, 1978 [FR] France ..... 78 03684

[51] Int. Cl.[3] ..... E04B 7/00

[52] U.S. Cl. ..... 52/262; 52/236.6; 52/236.7; 52/DIG. 15

[58] Field of Search ..... 52/262, 236.8, 236.6, 52/236.7, 79.1, 263, 18, DIG. 15

[56] References Cited

U.S. PATENT DOCUMENTS

| | | | |
|---|---|---|---|
| 1,821,015 | 2/1979 | Hull | 52/262 |
| 2,186,310 | 1/1940 | Von Hoeten | 52/236.7 |
| 2,211,384 | 8/1940 | Patterson | 52/236.6 |
| 2,356,304 | 8/1944 | Garbe | 52/262 |
| 2,641,449 | 6/1953 | Antony | 52/236.6 |

*Primary Examiner*—James A. Leppink
*Assistant Examiner*—Henry E. Raduazo
*Attorney, Agent, or Firm*—Oblon, Fisher, Spivak, McClelland & Maier

[57] ABSTRACT

A multi-use metal building comprises a skeleton composed of vertical posts connected to upper and lower horizontal longitudinal girders, thus forming a frame ensuring transverse and longitudinal stability.

In the horizontal plane, the skeleton comprises self-supporting metal trough elements modulated to the same width as the posts, with corrugated cross section, these trough elements resting on the upper longitudinal girders of the frame and serving on the one hand as floor support and on the other hand as roof.

The vertical walls (posts, upper and lower longitudinal girders, outer skin made of asbestos and inner insulating partition) ensure the vertical stability in both directions.

3 Claims, 1 Drawing Figure

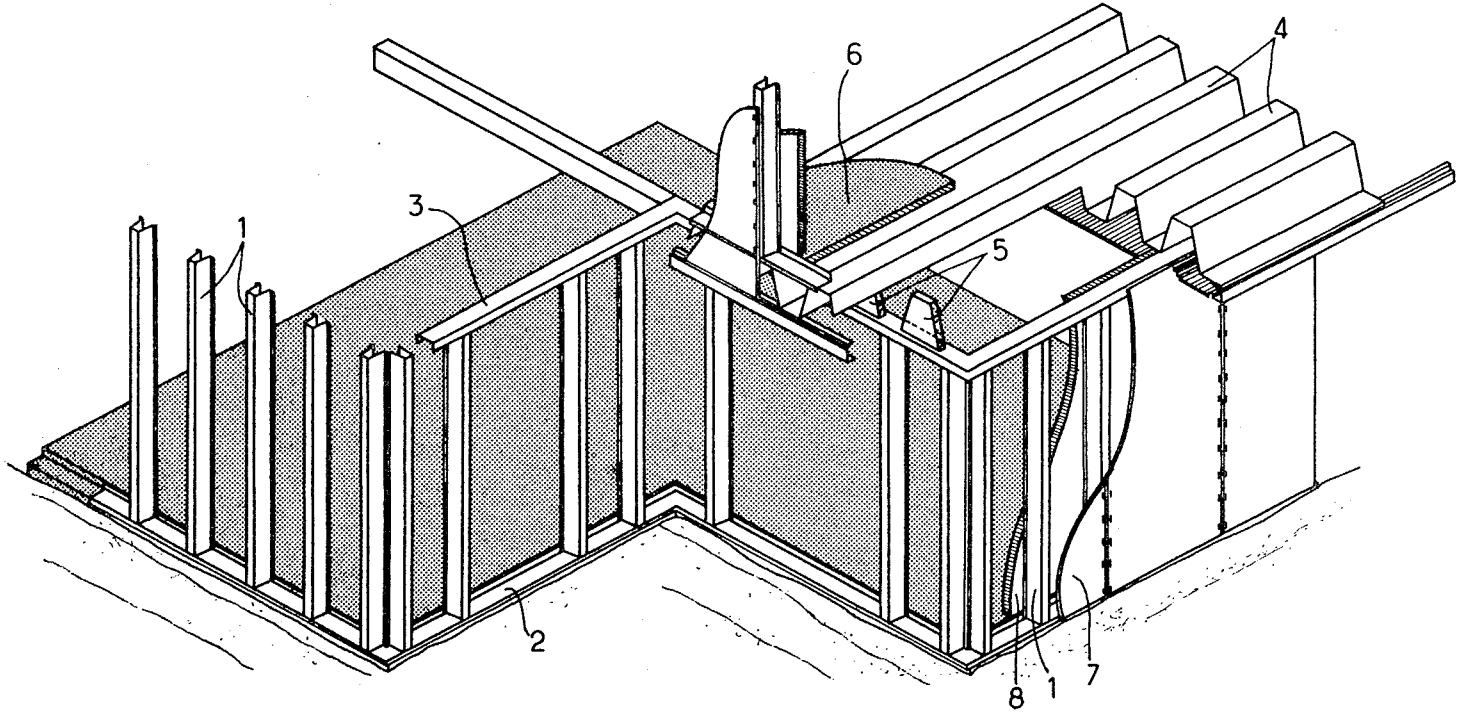
4
5
6
7
1
8
2
3
1

MULTI-USE METAL BUILDING

BACKGROUND OF THE INVENTION

The present invention relates to a multi-use metal building which may be used in particular as individual or collective dwelling, office, teaching premises, small industrial premises, etc.

Various metal buildings are already known which generally require the use of a large number of different parts and particularly materials which must be machined to obtain the desired dimensions. In addition, these buildings require the provision of points of support between opposite outside walls, this limiting the possibilities of use of the volumes created.

SUMMARY OF THE INVENTION

It is essentially an object of the present invention to remedy these drawbacks by providing a metal building of particular simple structure, modulated to a predetermined width and not requiring intermediate points of support.

To this end, the metal building comprises, in the vertical plane, a metal skeleton composed of vertical posts connected to lower and upper horizontal girders, thus forming a frame ensuring transverse and longitudinal stability, the vertical walls being constituted by an outer skin and by an inner insulating lining partition fixed on either side of the posts and the longitudinal girders and contributing to the wind-bracing of the frame formed by the longitudinal girders and the posts, and in the horizontal plane, self-supporting metal trough elements modulated to the same width as the posts; that is, the troughs are spaced by a distance equal to the distance between the posts. The corrugated cross section of the trough elements rests on the upper longitudinal girders of the frame and serves, on the one hand as floor support and on the other hand as roof.

The metal building according to the invention offers the advantage that it may be made by using materials available on the market without a particular machining being necessary. Expensive waste is thus avoided. It requires a very small number of different parts and consequently eliminates any time lost searching during assembly.

The extreme simplicity of the mode of assembly requires a virtually non-specialized manpower and only a small quantity of tools is necessary.

The elements constituting the building may be delivered in a kit, as the trough elements and posts may fit in one another, this thus allowing a simple packing with minimum volume and economical transport.

As, in the building according to the invention, there is a non intermediate point of support between two opposite outer walls, even in the case of a large span of up to 12 meters, from sheets of 12 to 15 tenths of millimeter, it is possible to envisage any interior distribution and the volumes obtained may be used as desired.

The horizontal roof constituted by the long trough elements without visible points of fixation and without longitudinal overlapping, eliminates the risks of leakage and, in addition, the trough elements serve as gutters.

BRIEF DESCRIPTION OF THE DRAWINGS

The invention will be more readily understood on reading the following description with reference to the accompanying drawing, in which:

The single FIGURE is a view in perspective, with parts torn away of a metal building according to the invention.

DESCRIPTION OF THE PREFERRED EMBODIMENT

Referring now to the drawings, this building comprises, in the vertical plane, a skeleton constituted by vertical posts 1 connected to upper and lower horizontal longitudinal girders 2 and 3 respectively, thus forming a frame ensuring transverse and longitudinal stability.

The posts 1 and longitudinal girders 2 and 3 may be made of sheet steel, Corten steel, galvanized steel, of suitable thickness, said sheet being milled, folded or stamped, or anodised or non-anodised aluminium sheet, which is milled, folded or stamped, or of extruded aluminium sections.

The posts 1 are prefabricated modules, for example of 0.60 m width.

In the horizontal plane, the building comprises self-supporting metal trough elements 4 with the same width (0.60 m for example) as the posts and ensuring horizontal stability in both directions. These trough elements have a trapezoidal section and the height of their corrugation is for example 0.400 m or 0.355 m.

The thin self-supporting trough elements 4 are made for example of sheet steel, Corten steel, galvanized steel, this sheet being milled, folded or stamped and being able to be coated with a layer of polyvinyl chloride, or of anodised or non-anodised aluminum sheet, which is milled, folded or stamped, or of extruded aluminum sections assembled simply by tightening.

The trough elements 4 serve both as floor support and as roof (only the thickness of the sheet or of the section being variable) and may receive a protecting layer, as a function of their nature.

The trough elements 4 preferably rest on the upper longitudinal girder 3 with the interposition of a supple or rigid insulating means (not shown).

Vertical closure and positioning elements 5 of trapezoidal section corresponding to that of the self-supporting trough elements 4 are fixed on the upper longitudinal girder 3 at intervals corresponding to the spaces between the trough elements. These elements 5 serve both as templates and closure elements at the ends of the trough elements 4.

A floor 6 is fixed on the self-supporting trough elements 4. This floor may be constituted, for example, by a corrugated sheet of standard asbestos cement, of which only the corrugations constituting the upper grooves are filled with concrete, making it possible to obtain a flat surface adapted to receive the floor coverings.

These corrugated sheets are butt jointed by means of small diameter steel wires embedded in the concrete.

The floor may also be made in sandwich form, with an insulating foam core and steel skins directly receiving the floor coverings. It may also be constituted by a dry, insulating or non-insulating floor, based on wood fibres.

These different types of floors are laid with the addition of a supple or rigid insulating means between the floor 6 and the self-supporting trough elements 4.

The outer vertical walls are constituted by an outer skin 7 made of standard asbestos cement and by an inner insulating partition 8 with double steam shield. The inner and outer panels may be chosen from the range of products responding to the technical conditions imposed by the climate or to the desired aesthetic conditions. The outer skin 7 and the inner insulating partition 8 are fixed on either side of the posts 1.

Angle pieces, panels or breast walls are made according to the same process.

The self-supporting trough elements made of steel or aluminium have the double purpose of floor support and of roof and they also ensure the horizontal stability in both directions.

The vertical walls (posts 1, upper and lower longitudinal girders 2 and 3, outer skin 7 made of asbestos and inner insulating partition 8) ensure the vertical stability in both directions.

All the jointings are effected by means of self-tapping and self-boring screws or rivets, resisting tear and shear, so that they do not necessitate prior machining.

As far as the self-supporting trough elements 4 made of aluminum are concerned, the extruded sections are jointed face to face by an aluminum piece which resists the buckling efforts of the thin walls.

From the above description, it is seen that the metal building according to the invention may be assembled very easily, with a very small number of different parts, using materials available on the market, without particular machining thereof. Furthermore, the use of the self-supporting trough elements 4 avoids the presence of any points of support between the opposite outside walls, this allowing complete freedom of use of the volumes thus crated.

What is claimed as new and desired to be secured by Letters Patent of the United States is:

1. A metal building comprising:

a vertical frame including a skeleton of vertical posts, said posts being arranged at predetermined spacings, and upper and lower longitudinal girders connecting said posts;

an outer skin fixed to said frame to one side thereof;

an inner lining fixed to said frame at the other side thereof;

a plurality of positioning elements fixed to opposing ones of said upper girders, said positioning elements having a predetermined profile and being spaced by said predetermined spacing of said posts; and at least one corrugated self-supporting metal trough element, the troughs of said corrugation being spaced by said predetermined spacing and having the same profile as said positioning elements, said at least one trough element being positioned on said upper longitudinal girders with said positioning elements inserted within said troughs, whereby said at least one trough element is held on said frame.

2. The metal building of claim 1 including at least two of said trough elements positioned on said upper longitudinal girders with no overlapping therebetween.

3. The metal building of claim 1 wherein each of said positioning elements are positioned midway between two of said posts.

* * * * *